US008414241B2

(12) United States Patent
Laenge

(10) Patent No.: US 8,414,241 B2
(45) Date of Patent: Apr. 9, 2013

(54) DEVICE AND METHOD FOR LOWERING OR LIFTING A LOAD IN WATER

(75) Inventor: Walter Laenge, Ludesch (AT)

(73) Assignee: Liebherr-Werk Nenzing GmbH, Nenzing (AT)

( * ) Notice: Subject to any disclaimer, the term of this patent is extended or adjusted under 35 U.S.C. 154(b) by 732 days.

(21) Appl. No.: 12/626,214

(22) Filed: Nov. 25, 2009

(65) Prior Publication Data

US 2010/0189541 A1 Jul. 29, 2010

(30) Foreign Application Priority Data

Dec. 1, 2008 (DE) ..... 10 2008 059 805

(51) Int. Cl.

| | |
|---|---|
| ***B63C 11/00*** | (2006.01) |
| ***B63C 11/42*** | (2006.01) |
| ***E21B 41/00*** | (2006.01) |
| ***E21B 41/04*** | (2006.01) |
| ***B63B 21/22*** | (2006.01) |

(52) U.S. Cl.
USPC ..... 414/137.7; 405/193; 254/277; 114/258; 114/317; 114/331

(58) Field of Classification Search ..... 114/258, 114/317, 331, 333, 50; 166/355; 212/273, 212/308, 318; 254/277, 392, 900; 294/68.3, 294/81.1; 37/310; 405/188, 191, 193, 203, 405/205, 206, 209, 224
See application file for complete search history.

(56) References Cited

U.S. PATENT DOCUMENTS

| | | | | |
|---|---|---|---|---|
| 1,097,335 | A | 5/1914 | Koesis | |
| 3,024,615 | A * | 3/1962 | Aschinger | 405/191 |
| 3,807,334 | A * | 4/1974 | Egeberg | 114/268 |
| 4,132,387 | A * | 1/1979 | Somerville et al. | 254/340 |
| 4,236,695 | A * | 12/1980 | Morrison | 254/277 |
| 5,069,580 | A | 12/1991 | Herwig et al. | |
| 6,082,947 | A * | 7/2000 | Adamson | 414/137.7 |
| 6,588,985 | B1 * | 7/2003 | Bernard | 405/191 |
| 6,772,705 | B2 * | 8/2004 | Leonard et al. | 114/333 |
| 6,935,262 | B2 | 8/2005 | Roodenburg et al. | |
| 7,311,469 | B2 * | 12/2007 | Pollack et al. | 405/193 |
| 2005/0160959 | A1 * | 7/2005 | Roodenburg et al. | 114/258 |
| 2006/0042534 | A1 * | 3/2006 | Pollack et al. | 114/258 |
| 2007/0272906 | A1 * | 11/2007 | Davidson | 254/270 |

FOREIGN PATENT DOCUMENTS

WO 2006/000919 1/2006

OTHER PUBLICATIONS

ISA German Patent and Trademark Office, Search Report of 10 2008 059 805.4, May 4, 2009, Germany, 4 pages.

* cited by examiner

*Primary Examiner* — Gregory Adams
(74) *Attorney, Agent, or Firm* — Alleman Hall McCoy Russell & Tuttle LLP

(57) ABSTRACT

The present disclosure relates to a device for lifting and lowering a load in water, including a hoisting gear with a first hoisting rope and a storage drum with a second hoisting rope, which preferably are arranged on a floating unit. In accordance with the present disclosure, a hoisting gear frame is fastened to the first hoisting rope, whose buoyancy in water is variably adjustable. Furthermore, the present disclosure relates to a method for lifting and lowering a load in water by using such a device.

25 Claims, 2 Drawing Sheets

DEVICE AND METHOD FOR LOWERING OR LIFTING A LOAD IN WATER

CROSS REFERENCE TO RELATED APPLICATION

This application claims priority to German Patent Application No. 10 2008 059 805.4, filed Dec. 1, 2008, which is hereby incorporated by reference in its entirety for all purposes.

TECHNICAL FIELD

The present disclosure relates to a device and a method for lifting and lowering a load in water, comprising a hoisting gear with a first hoisting rope and a storage drum with a second hoisting rope, which preferably are arranged on a floating unit.

BACKGROUND AND SUMMARY

For erecting offshore plants, such as oil rigs, wind turbines or others, in waters with all kinds of properties different components or loads must be lifted, moved or also lowered. It can occur, for instance, that during construction of an offshore plant heavy components or loads must be lowered onto the sea bed. In general, this kind of work is performed from floating units, wherein the load to be transported is carried by a hoisting gear attached to a crane or by a hoisting gear directly mounted on a floating unit.

The problem is that these floating units are exposed to heave-related movements. In general, these movements are transmitted even more to the hoisting gears used and, if cranes are used, also to the crane itself. Hence, the load present on the hoisting gear also undergoes accelerations, which lead to an increased weight force of the load which must be borne by the systems. Moreover, in the vicinity of the "splash zone", i.e. when the load is partly in the water and partly in the air, additional loads are produced as a result of hydrodynamic effects caused by the heave and by movements of the floating unit. The strength of said loads is dependent on the geometry of the floating units employed and on the load to be transported and depending on size can therefore have a considerable influence on the forces occurring in the system. The effects described above altogether require a reinforced construction of the components used for the hoisting gears and the cranes, which leads to a fast increase of the production and maintenance costs of such systems.

When the load is lowered further below a certain depth of water, it reaches a region which is calmed to such an extent that the heave has no major influence on the load and the part of the hoisting system lying under water. The load then can rapidly be lowered until it almost touches the sea bed or the place of destination of the load. At this moment at the latest, a suitable control in the hoisting gear used must compensate the movements of the hoisting winch and the crane on the floating units generated by the heave, so that the load can be put down on the sea bed or the place of destination slowly and safely.

Such compensating control also is referred to as heave compensation and should ensure that the hoisting rope on which the load is suspended is kept taut, in order to avoid shocks when picking up and putting down the load. Due to the heave, the floating unit or the load undergoes position movements which lead to abruptly varying distances between load and hoisting systems or floating units. The heave compensation of the hoisting winch must react to the respective situation and for instance provide more hoisting rope or wind up some hoisting rope. The problem described above, however, relates to very great loads, whereby such compensating control (heave compensation) involves very high demands as to the capacity of the hoisting winch used. In general, such high powers only can be achieved by incorporating an energy storage device, which likewise leads to greatly increasing production costs, since the availability of such cranes is rather low.

Another problem consists in the partly very great depth of water into which the loads to be transported should be lowered. The rope lengths required for this purpose lead to further aspects which must be considered in the use and production of such hoisting systems. For instance, the elastic rope together with the load provides a separate oscillating system, which is superimposed on the moving system of the floating unit. Therefore, a heave compensation means must also compensate these additional oscillations, which presently represents an unsolved problem.

When designing such hoisting systems, it is furthermore necessary to consider the transfer of a load from a moving acceleration system, i.e. on the water surface, into a quasi stationary system, i.e. a certain depth of water in which the load is located.

The problems with the design of offshore devices for lowering and lifting loads can be summarized as follows:

- strong crane for traversing the splash zone,
- the hoisting winch used must be equipped with a heave compensation means,
- the hoisting winch used must have a high power or an energy storage system,
- gradual transfer from an oscillating system into a rest condition,
- additional oscillations.

Therefore, it is the object of the present disclosure to provide a device and a method which simplifies hoisting work in the offshore region.

In accordance with the present disclosure, this object is solved by a device for lifting and lowering a load in water, comprising a hoisting gear with a first hoisting rope and a storage drum with a second hoisting rope, which preferably are arranged on a floating unit, wherein a hoisting gear frame is fastened to the first hoisting rope, whose buoyancy in water is variably adjustable. For this purpose, the device includes a hoisting gear with a first hoisting rope and a storage drum with a second hoisting rope, which preferably are arranged on a floating unit, wherein a hoisting gear frame, whose buoyancy in water is variably adjustable, is fastened to the first hoisting rope. The storage drum serves to wind up the second hoisting rope, wherein the portions of the hoisting rope to be wound up are not exposed to any forces. The first hoisting rope of the hoisting gear is fastened to said hoisting gear frame, which forms an independent floating unit. By means of suitable measures, the buoyancy of the hoisting gear frame can be adjusted. Buoyancy is defined as a force acting against gravity. This means that a force can be generated by this variable buoyancy, which acts against the gravity of the hoisting gear frame, can compensate the same and thus can bring the hoisting gear frame into a "floating condition". In accordance with the present disclosure, a changed weight force of the hoisting gear frame, for instance due to a load suspended on the hoisting gear frame, can be compensated by increasing the buoyancy. The hoisting gear frame of the present disclosure thus is capable of holding itself at a predefined depth of water without any further drives.

Advantageously, the hoisting gear frame comprises an overpressure hoisting gear frame, whereby the buoyancy of the overpressure hoisting gear frame can be adjusted. The overpressure hoisting gear frame includes an air cell, wherein the buoyancy of the hoisting gear frame is increased when filling the air cell with air and the buoyancy of the overpressure hoisting gear frame is reduced when draining the air from the air cell.

Advantageously, a traction sheave drive is arranged in the overpressure hoisting gear frame, which drives a second hoisting rope. A traction sheave drive consists of at least one traction sheave over which an associated hoisting rope is guided. The rope is not attached to the traction sheave, but is retained and moved by friction. To increase the contact surface and hence the friction, the traction sheave has grooves into which the hoisting rope is pressed by the tensile stress.

Preferably, the traction sheave drive comprises at least two traction sheaves.

In a furthermore advantageous way, the at least two traction sheaves of the traction sheave drive are independently controllable. As a result, a uniform structure of the rope system can be ensured.

Advantageously, the second hoisting rope is guided from the storage drum over the traction sheave to the load to be moved and is fastened to the load with its rope end. Thus, the weight force of the load only is applied in the region of the hoisting rope between traction sheave and load. In the region of the rope between storage drum and traction sheave, no tensions are applied to the hoisting rope, whereby the required power of the storage drum for winding up the hoisting rope is reduced to a minimum.

Alternatively, the second hoisting rope in the hoisting gear frame can be driven by a hoisting winch, wherein the second hoisting rope is guided from this hoisting winch to the load and is fastened to the same.

Advantageously, a fiber rope is used as second hoisting rope.

The use of a steel rope as second hoisting rope can also be advantageous.

Preferably, the second hoisting rope is dimensioned such that its load bearing capacity is appropriate for the load to be borne and relatively small hoisting load coefficients can be employed. The second hoisting rope performs the hoisting work on the load in a depth of calmed water. As a result, the above-mentioned influences on the hoisting system must only be considered to a small extent when dimensioning the hoisting rope.

Advantageously, an arrangement of a holding brake is provided, which acts directly on the second hoisting rope. This should prevent a fast unintended lowering of the load from the hoisting gear frame.

Furthermore advantageously, an additional cable drum for a supply cable is provided on the floating unit. The drive units for the storage and cable drums can be arranged on the floating unit individually or jointly.

Advantageously, said supply cable comprises a control line and/or a power supply line. Preferably, the supply cable is connected to the hoisting gear frame and the traction sheave drive or hoisting winch drive arranged therein is controlled by the control lines and supplied with electricity from the floating unit by the power supply lines.

What is advantageous is the use of a crane with a hoisting winch for said hoisting gear. The crane can have a slewable, telescopable boom with a deflection pulley arranged at the tip of the boom. What is likewise possible is the use of a lattice mast crane or other crane configurations known according to the prior art.

Advantageously, the hoisting winch of the hoisting gear or of said crane comprises a heave compensation. The heave compensation serves to compensate the heave-related movements of the individual components of the device and thus should ensure an appropriate constant tightening of the hoisting rope between hoisting winch and hoisting gear frame or the load.

In a furthermore advantageous way, at least one further hoisting gear, preferably a crane, can be provided for lifting the load or the hoisting gear frame. The same either can support the first crane or be used for instance for lowering the load through the splash zone. The hoisting gear, in particular the hoisting winch, likewise can comprise a heave compensation, so as to compensate external influences, such as the heave, on the hoisting system. The additional further hoisting gears can be arranged together with or separate from the first hoisting gear. It may be advantageous, for instance, to separately arrange a further hoisting gear on a further independent floating unit. Furthermore, coupling the hoisting gears used in terms of control is also possible, wherein either some or all hoisting gears together are controlled from a central control unit.

In accordance with a further aspect of the present disclosure, the air cell in the overpressure hoisting gear frame is controlled by the control lines of the supply cable. As a result, the buoyancy and the adjustable drive of the traction sheaves can be controlled centrally from the floating unit. By emitting certain control signals, the crane operator thus can accomplish lifting or lowering of the load or manually configure the buoyancy of the overpressure hoisting gear frame. Preferably, the buoyancy of the overpressure hoisting gear frame is controlled via compressed air by means of the air cell. It is possible to supply said compressed air to the air cell via a supply cable, but alternative ways of supplying the air cell with compressed air are also conceivable.

In an advantageous way, the control of the air cell is effected in dependence on the respective force applied to the first hoisting rope. For this purpose, the force applied to the first hoisting rope is determined by a non-specified device for measuring the force on the hoisting rope. The same represents the difference between the weight force of the hoisting gear frame and the buoyant force of the hoisting gear frame. If this difference tends towards the value 0, the hoisting gear frame is in a kind of floating condition in the water. However, if the weight force of the hoisting gear frame is influenced from outside, for instance by suspending a load, a force must be borne by the first hoisting rope which corresponds to the difference between buoyant force and weight force of the hoisting gear frame. By increasing the buoyant force of the hoisting gear frame by means of a suitable control of the supply of compressed air, advantageously automated by an electric control unit, the force applied to the second hoisting rope can be minimized to a predefined value.

In accordance with the present disclosure, the object mentioned above is solved by a method for lowering or lifting a load in the offshore region by using the devices described above with the method steps comprising the following:

a. picking up a load from a transportation unit by a hoisting rope fastened to the load and connected with a second hoisting system or crane and lowering the load through the splash zone down to a defined depth with calmed water;
b. tightening the second hoisting rope by means of the traction sheave drive or the hoisting winch of the overpressure hoisting gear frame;
c. controlling the buoyancy of the overpressure hoisting gear frame;
d. knocking off the hoisting rope of the second hoisting system or crane from the load; and e. lowering the load by means of the traction sheave or hoisting winch drive down to the predefined deposition point.

In the first step, the load to be transported is picked up from a transportation unit by a hoisting rope fastened to the load and connected with a second hoisting system or crane. The load is loosely connected with the second hoisting rope of the hoisting gear frame, which is fastened to a first hoisting rope of a first hoisting gear.

By means of the second hoisting system directly fastened to the load, the load now is lowered through the "splash zone" down to a depth of calmed water. By controlling the traction sheave drive or the hoisting winch of the hoisting gear frame, the second hoisting rope is tightened, whereby a tension is obtained between load and hoisting gear frame. At the same time, the buoyancy of the hoisting gear frame is incrementally increased by the control, preferably by the electric control unit. Thus, the second hoisting rope of the traction sheave drive gradually takes over the load from the hoisting gear of the second hoisting gear system.

After 100% of the load are transferred to the second hoisting rope of the hoisting gear frame and the buoyancy of the hoisting gear frame is suitably adapted, the hoisting rope of the second hoisting gear is knocked off from the load. Thus, the weight force of the load only is applied to the second hoisting rope of the hoisting gear frame.

Subsequently, the load is lowered down to the predefined deposition point, for instance the sea bed, by means of the traction sheave or hoisting winch drive.

Advantageously, the control of the buoyancy of the hoisting gear frame is coupled to the resultant residual force on the first hoisting rope. This means that during transfer of the load from the hoisting rope of the second hoisting system to the second hoisting rope of the hoisting gear frame, the buoyancy of the hoisting gear frame must be increased continuously. Preferably, these steps of increasing the buoyancy are suitably adapted to the resultant residual force measured on the first hoisting rope, which can be performed manually or also automatically.

In a furthermore advantageous way, the vertical position of the hoisting gear frame in the water with respect to the watercourse bed is ensured, or maintained, by the heave compensation of the first hoisting system or crane. In particular the movements of the floating unit, which are caused by the heave, must be compensated automatically. In the case of a wave crest, for instance, more hoisting rope must be provided by the heave compensation of the first hoisting system, in order to prevent the hoisting gear frame from being lifted inadvertently by the first hoisting rope.

Alternatively, said requirement of the heave compensation of the first hoisting gear, i.e. ensuring, or maintaining, the vertical position of the hoisting gear frame in the water with respect to the watercourse bed, can be ensured by the second hoisting system.

Further features, details and advantages of the present disclosure will be explained in detail below with reference to an embodiment illustrated in the drawing.

DETAILED DESCRIPTION

Figure 1:
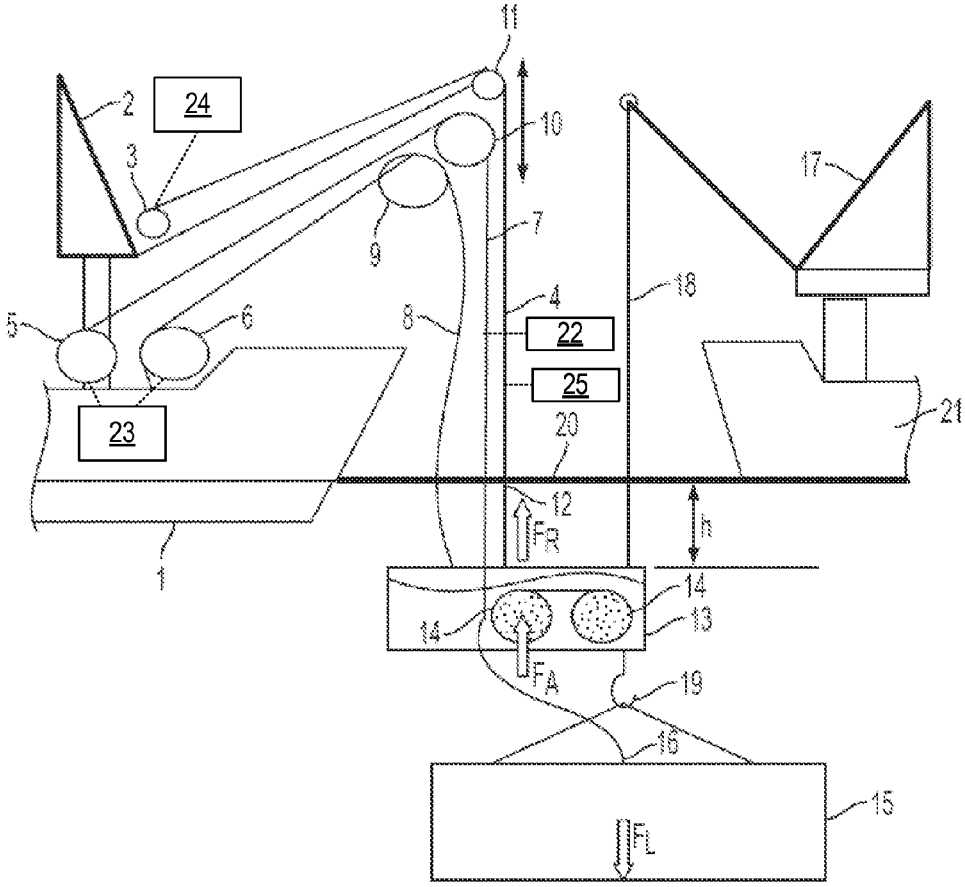
FIG. 1 shows a device for lowering or lifting a load in the offshore region in a configuration of a preferred embodiment of the present disclosure.

The only Figure shows a "strong" crane 17 on a unit 21 floating on the water surface 20, with the load 15 to be borne being fastened to its hoisting rope 18 in a fastening point 19. The construction of the strong crane 17 is dimensioned such that the load can be lowered through a so-called "splash zone" down to a predefined water depth h. In said "splash zone", the regular weight force FL of the load 15 acting on the material used is amplified by external influences resulting from the movements of the load and the floating units, and thus requires a distinctly stronger design of the crane components of the crane 17.

From the water depth h, the load is located within a calmed system, i.e. external circumstances, such as the heave of the watercourse, only have a negligeable influence on the load.

Furthermore, a first "weak" crane 2 with a hoisting rope 4, which is fastened to a hoisting gear frame 13 in a fastening point 12, is arranged on another unit 1 floating on the water surface 20. The hoisting rope 4 is driven by the hoisting winch 3 mounted on the crane 2 and deflected via a deflection pulley 11. In addition, a storage drum 5 and a cable drum 6 are provided on the floating unit 1. From the cable drum 6, a supply cable 8 is guided over a deflection pulley 9 to the hoisting gear frame 13 and can be wound up on and unwound from the cable drum 6 depending on the water depth of the hoisting gear frame 13.

In the Figure, the hoisting gear frame 13 reveals a traction sheave drive with two traction sheaves 14 to be actuated or driven separately. Said hoisting rope 7 is guided from a fastening point 16 on the load 15 to the traction sheaves 14 of the hoisting gear frame 13. The traction sheave mechanism known to one of skill in the art can lift or lower the load 15 by the traction sheaves 14 via the hoisting rope 7. Furthermore, the loose end of the hoisting rope 7 is directed from the traction sheaves 14 over the deflection pulley 10 to the storage drum 5. In the ideal case, however, no force or tension acts on the hoisting rope 7 in the region between the traction sheaves 14 and the storage drum 5. Thus, a relatively small power is required for the process of winding and unwinding the hoisting rope 7 of the storage drum 5.

The applied forces on the system are represented in the Figure by the corresponding arrows. The arrow with the designation FL shows the weight force of the load 15, the arrow with the designation FA shows the buoyant force of the hoisting gear frame 13, and the arrow with the designation Fr shows the resultant force acting on the hoisting rope 4. In simple terms, the resultant force Fr is calculated from the difference of weight force FL and buoyant force FA. For controlling the traction sheave drive or the hoisting winch drive of the hoisting gear frame 13, the supply cable 8 is used.

Figure 2:
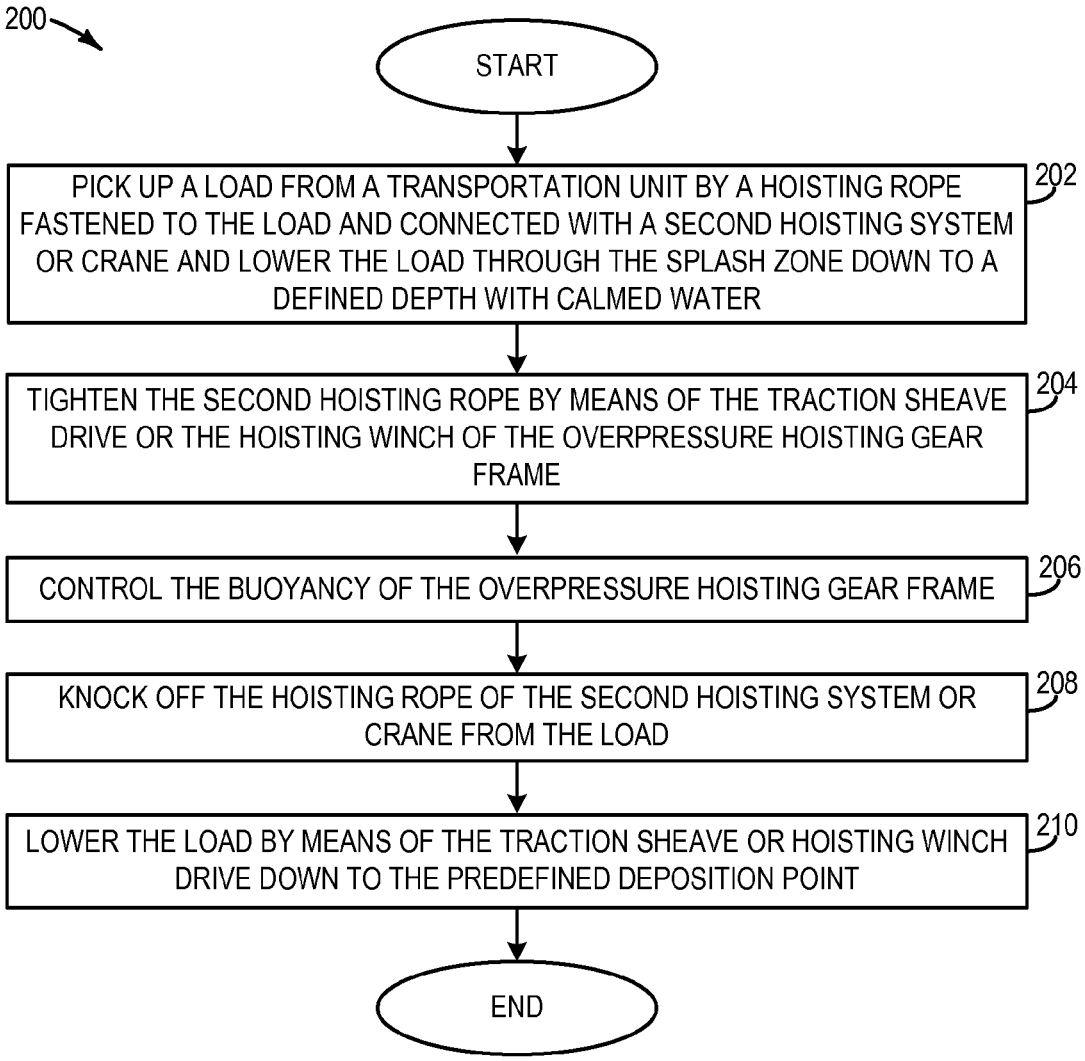
FIG. 2 shows an example method for lowering or lifting the load in the offshore region.

A method for lifting and lowering the load in water with the configuration of FIG. 1 is now illustrated with regard to FIG. 2. Specifically, FIG. 2 shows a method 200, which includes at 202, picking up the load from the transportation unit by the hoisting rope fastened to the load and connected with the second hoisting system or crane and lowering the load through the splash zone down to a defined depth at which the water is sufficiently calm. Then, at 204, the method includes tightening the second hoisting rope by the traction sheave drive or the hoisting winch of the overpressure hoisting gear frame. Then, at 206, the method includes controlling, e.g., automatically adjusting in response to operating conditions, the buoyancy of the overpressure hoisting gear frame. Then, at 208, the method includes knocking off the hoisting rope of the second hoisting system or crane from the load. Then, at 210, the method includes lowering the load by the traction sheave or hoisting winch drive down to the predefined deposition point.

A holding brake 22 may be provided which directly acts on hoisting rope 7. One or more drive units 23 for the storage and cable drums may be arranged on the floating unit 1 individually or jointly. The hoisting winch 3 may comprise a heave compensation 24. A measuring device 25 may be arranged on the hoisting rope 4 to measure a resultant force applied on the hoisting rope.

In one specific example for lowering the load 15 onto a certain region, for instance the watercourse bed, the following more detailed method for lowering or lifting a load can be realized, which can be subdivided into the following method steps:

1. In the fastening point 19, the load 15 is fastened to the hoisting rope 18 of the crane 17, which is located on the floating unit 21. At the same time, the hoisting rope 7 is also connected with the load 15 in a fastening point 16, with no tensions or forces, however, acting on the hoisting rope portion of the hoisting rope 7 between hoisting gear frame 13 and load 15.
2. By means of the crane 17, the load 15 now is transferred from a non-illustrated transportation unit onto the water surface 20, wherein at the same time the hoisting gear frame 13 connected with the load 15 likewise is put down onto the water surface 20 by means of the crane 2 via a hoisting rope 4 connected in the fastening point 12.
3. The load 15 and the hoisting gear frame 13 are moved by the two cranes 2, 17 through the splash zone down to a depth h with calmed water. The rocking movements of the floating units 1, 21 and of the load 15 and the hoisting gear frame 13 must be compensated by the heave compensations of the two cranes 2 and 17. Furthermore, the heave compensation of the crane 2 ensures that the hoisting gear frame 13 does not change its vertical position with respect to the sea bed.
4. Upon reaching the depth h, the hoisting rope 7 slowly is tightened by the traction sheave drive by means of the traction sheaves 14 of the hoisting gear frame 13 and thus slowly takes over the load 15 from the hoisting rope 18 of the crane 17. When the hoisting rope 7 is tightened, the buoyancy of the hoisting gear frame 13 at the same time is varied such that the resultant force Fr on the hoisting rope 4 of the crane 2 remains constant and the hoisting gear frame floats in a predefined depth. The power of the heave compensation of the crane 2 is not changed thereby.
5. The control of the traction sheave drive of the hoisting gear frame 13 and the control of the buoyancy with the force FA is effected with reference to the signals transmitted via the control line of the supply line 8. The drive of the traction sheave drive of the hoisting gear frame 13 is supplied with electricity by a power supply in the supply cable 8.
6. When the hoisting rope 7 has taken over 100% of the load 15 from the crane 17, the hoisting rope 18 of the crane 17 is knocked off from the load 15.
7. The load 15 is moved down to the sea bed by means of the traction sheave drive and slowly put down. Lowering the load 15 by the hoisting system of the hoisting gear frame 13 now can be effected shock-free, since the hoisting gear frame 13 and the load 15 are located in a calmed water depth h. This water depth can be interpreted as a quasi stationary system.

The lifting operation is performed in the opposite order. The load 15 is lifted by the hoisting gear frame 13 and the hoisting rope 7 and lifted from the calmed water depth h through the splash zone onto a non-illustrated transportation unit by means of the crane 17.

The invention claimed is:

1. A device for lifting and lowering a load in water, comprising:

a hoisting gear with a first hoisting rope and a storage drum with a second hoisting rope, which are arranged on a floating unit; and a hoisting gear frame, the hoisting gear frame being fastened to the first hoisting rope, and the hoisting gear frame having a variably adjustable buoyancy in water, wherein the variably adjustable buoyancy of the hoisting gear frame is an overpressure hoisting gear frame which includes an air cell, and wherein the overpressure hoisting gear frame includes a variably adjustable buoyancy in water and has a traction sheave drive arranged therein, which drives the second hoisting rope.

2. The device according to claim 1, wherein the traction sheave drive comprises at least two traction sheaves.

3. The device according to claim 2, wherein at least two traction sheaves of the traction sheave drive are independently adjustable.

4. The device according to claim 3, wherein the second hoisting rope is guided from the storage drum over one or more of the traction sheaves to the load and is fastened to the load with its rope end.

5. The device according to claim 4, wherein an unloaded end of the second hoisting rope is loosely guided from the one or more traction sheaves of the overpressure hoisting gear frame to the storage drum on the floating unit.

6. The device according to claim 1, wherein the second hoisting rope in the overpressure hoisting gear frame is driven by a hoisting winch, wherein the second hoisting rope is guided from this hoisting winch to the load and is fastened to the hoisting winch.

7. The device according to claim 1, wherein the second hoisting rope is a fiber rope.

8. The device according to claim 1, wherein the second hoisting rope is a steel rope.

9. The device according to claim 1, wherein a holding brake is provided, which directly acts on the second hoisting rope.

10. The device according to claim 1, wherein an additional cable drum for a supply cable is arranged on the floating unit.

11. The device according to claim 10, wherein drive units for the storage and cable drums are arranged on the floating unit individually or jointly.

12. The device according to claim 11, wherein said supply cable comprises a control line and a power supply line.

13. The device according to claim 12, wherein the supply cable is connected to the overpressure hoisting gear frame and the traction sheave drive or hoisting winch drive arranged therein is controlled by the control line and supplied with electricity by the power supply line.

14. The device according to claim 1, wherein said hoisting gear is a crane with at least one hoisting winch.

15. The device according to claim 14, wherein the hoisting winch of the hoisting gear comprises a heave compensation.

16. The device according to claim 1, wherein at least one further hoisting gear is provided for lifting the load with an additional hoisting rope or the overpressure hoisting gear frame, which selectively comprises a heave compensation.

17. The device according to claim 16, wherein the further hoisting gears are arranged separate from the first hoisting gear on a further independent floating unit.

18. The device according to claim 12, wherein the air cell in the overpressure hoisting gear frame is controlled by the control line of the supply cable.

19. The device according to claim 1, further comprising a measuring device for measuring a resultant force applied on the first hoisting rope, the measuring device arranged on the first hoisting rope.

20. The device according to claim 19, wherein control of the buoyancy of the overpressure frame is effected in dependence on the measured force on the first hoisting rope.

21. The device according to claim 20, wherein control of the buoyancy is controlled automatically by an electric control unit.

22. A method for lifting and lowering a load in water with a device comprising the following steps:

a. picking up the load from a transportation unit by a first hoisting rope of a first hoisting system fastened to the load and connected with a second hoisting system or crane and lowering the load through a splash zone down to a defined depth at which the water is calm;

b. tightening a second hoisting rope of the second hoisting system by a traction sheave drive or a hoisting winch of an overpressure hoisting gear frame;

c. controlling a buoyancy of the overpressure hoisting gear frame;

d. knocking off the hoisting rope of the second hoisting system or crane from the load; and e. lowering the load by the traction sheave or hoisting winch drive down to a predefined deposition point.

23. The method according to claim 22, wherein the controlling of the buoyancy of the overpressure hoisting gear frame is based on a resultant residual force on the first hoisting rope.

24. The method according to claim 23, further comprising providing heave compensation of the first hoisting system or crane to ensure a vertical position of the overpressure hoisting gear frame in water with respect to a watercourse bed.

25. The method according to claim 22, further comprising providing heave compensation of the first hoisting system or crane, wherein said heave compensation and hence a vertical position of the overpressure hoisting gear frame in water with respect to a watercourse bed is ensured by the second hoisting system or crane.

* * * * *